US005562539A

United States Patent [19]

Hashimoto et al.

[11] Patent Number: 5,562,539

[45] Date of Patent: Oct. 8, 1996

[54] CLEAN SPACE SYSTEM

[75] Inventors: Naoyuki Hashimoto; Sakae Kobayashi, both of Hirakata; Youichi Nakamura, Katano, all of Japan

[73] Assignee: Matsushita Electric Industrial Co., Ltd., Osaka, Japan

[21] Appl. No.: 373,522

[22] Filed: Jan. 17, 1995

Related U.S. Application Data

[63] Continuation of Ser. No. 869,742, Apr. 16, 1992, abandoned.

[30] Foreign Application Priority Data

Apr. 17, 1991 [JP] Japan ..... 3-085095

[51] Int. Cl.[6] ..... F24F 3/16

[52] U.S. Cl. ..... 454/187; 454/140; 454/230

[58] Field of Search ..... 55/385.2; 454/69, 454/140, 187, 230, 233

[56] References Cited

U.S. PATENT DOCUMENTS 4,967,645 11/1990 Mattson ..... 454/187 X 5,139,459 8/1992 Takahashi et al. ..... 454/187

FOREIGN PATENT DOCUMENTS 19661 2/1978 Japan ..... 454/187

213754 10/1985 Japan ..... 454/187

63-131941 6/1988 Japan .

233231 9/1988 Japan ..... 454/187

*Primary Examiner*—Harold Joyce

*Attorney, Agent, or Firm*—Ratner & Prestia

[57] ABSTRACT

A clean space system prevents pollution of clean surroundings in a processing space. Pollution is avoided which could otherwise occur when a worker comes in contact with the processing space while carrying out processes and operations in the clean surroundings. The apparatus includes a clean processing space, in which the processes and operations are carried out, and a preparing space coupled with an opening for work in the processing space. The preparing space is used by the worker prior to entering the processing space. In the preparing space, the worker performs preliminary actions such as changing his clothes and cleaning himself using an air shower to remove particles from his body.

1 Claim, 7 Drawing Sheets

CLEAN SPACE SYSTEM

This application is a continuation of application Ser. No. 07/869,742 filed Apr. 16, 1992 abandoned.

BACKGROUND OF THE INVENTION

The present invention relates to a clean space system and, in detail, to a clean space system for making a so-called clean space used for carrying out various operations which are adversely effected by dust in the air, in a production line for a semiconductor apparatus and the like.

In a production line for ultraprecise articles such as semiconductor apparatuses and the like, even if minute dust exists in the air, the quality and capabilities of the articles are adversely affected. Therefore, in a production line of this kind, various operations are carried out in a so-called clean room maintained in clean surroundings where dust in the air is eliminated at a high standard.

Especially, in a process which requires highly clarified surroundings wherein particles having a particle diameter of 0.5 μm or more must be 100 pieces or less in 1 $ft^3$ of air, (this is referred to as surroundings of class 100 or more) only articles to be processed and a processing apparatus are accommodated in the processing space. All the operations are carried out by automatic or remote control and it is unnecessary to carry out the operations by the worker entering into the processing space.

However, even in a case where a process and an operation are carried out without a worker in a clean space which is completely separated from outside surroundings, when inspection or repair of facilities and an apparatus in a processing space are carried out or when a part or a whole of a processing apparatus and the like is replaced, there is a situation where the worker desirably enters the processing space. In this case, the worker goes in and out by opening a doorway arranged at a part of the processing space. However, in this case, the degree of cleanliness of the processing space greatly decreases by air entering from outside surroundings. After the work ends and the worker goes out from the processing space, this processing space is returned to an initial clean atmosphere by operating an air-circulator or catching dust by an air-filter which is arranged in the processing space. However, before completion of this clarification, a new process and operation can not be initiated and, as a result, the operating efficiency or productivity of the production line is greatly reduced. Also, if the processing space is polluted to a high concentration, there is a case where the clarification can not sufficiently be carried out by a clarifying means in the processing space.

SUMMARY OF THE INVENTION

Therefore, it is an object of the present invention to provide a clean space system arranged in the production line as described above, which does not disturb the clean surroundings in a processing space by a worker entering into the processing space and, for this, which is able to realize facilities having a simple structure with a low cost.

A clean space system relating to the present invention is made by arranging a processing space where various kinds of processes and operations are carried out in clean surroundings, and by arranging a preparing space and waiting space coupled with an opening for work of the processing space, where the worker to perform various operations in the processing space carries out preparations such as clothes-change and an action to clarify himself.

The processing space is a space where a process necessary in a production line comprising, for example, formation of various thin films, etching, thermal treatment and so on, in the semiconductor wafer process technology, is carried out. In the processing space, there is arranged a processing apparatus necessary for each of the processes, a transporting means to transfer articles to be processed between each of the processes, and a transferring means to shift the articles to be processed between the transporting means and the processing apparatus. Also, in the processing space, there are arranged facilities to clean by removing pollution particles from the surroundings in the processing space such as an air-filter, a dust catcher, an air-circulator to flow a controlled air current in a specific region in the processing space and the like. Furthermore, if necessary, there are arranged air-conditioning facilities to control temperature and humidity in the processing space. A structure of these fundamental processing spaces is similar to that of a processing space in a common production line. In the processing space and in each of the processes, there is arranged an opening through which a worker goes in and out, or an opening through which, in certain cases, only a part of the worker such as an arm enters, at a position where direct work by the worker is required. This opening for work is separated from outside surroundings by a door capable of freely opening and closing or which is coupled into one body with the aforementioned preparing space. The preparing space is set and fixed similarly to the case of a hitherto-known clean room.

In the preparing space, in order to prevent the clean surroundings in the preparing space from being polluted by a worker who performs various operations for the processing space, there are arranged facilities for a worker to clean himself such as a room to change his clothes to a clean working uniform and a shower room to wash out polluted particles attaching to the worker body by an air-shower and so forth. In the preparing space, there is arranged an entrance through which a worker enters from outside surroundings and an exit through which a clarified worker goes out.

One or several workers cleaned in the preparing space wait in the waiting space and, during waiting, the waiting space is brought to couple with the processing space. The waiting space is a tightly closed space which is cleaned to remove pollution particles to the same degree (or less) as that of the processing space. Therefore, it is preferred to arrange a pollution particle removal means in the waiting space similar to that in the processing space. However, when coupled with the preparing space, the waiting space may be clarified by a clarifying means arranged in the waiting space. On at least one face of the waiting space, there is arranged an opening capable of coupling with an opening for work in the processing space. This opening is made so as to be able to shut tightly by a door capable of freely opening and closing. Also, the opening has a shelter structure to prevent invasion of external air and pollution substances from the coupled part. The waiting space is not only for the worker to wait in until he moves from the preparing space to the processing space, but also for carrying out various operations in a condition that the worker being placed in the waiting space holds out his arm or a part of his body into the processing space.

A waiting space as described above is arranged on the transferring body. Preferable transferring bodies may run by wheels like an automobile and may run along a railroad or a rail and, in addition, a structure for various body transferring, that are common means to transport habitants, can be adopted. A preferable driving means for the transferring body equipped with the waiting space is a electric motor by which pollution of surroundings is minimized. Also, it may have only wheels on the transferring body and be moved by a human power. The transferring body may be controlled in the running initiation and end, velocity and running direction, or the worker himself in the waiting space may operate an operating means being equipped in the waiting space of the transferring body.

There is, in the transferring body, a case where the waiting space is only arranged and a case where the waiting space and the aforementioned preparing space are arranged by being united into one body. In the case where the waiting space is only arranged, there is arranged an opening coupled with the opening for work of the above-mentioned processing space and an opening coupled with an exit of the preparing space. In the case where the waiting space and preparing space are united into one body, the exit of the preparing space is united with the opening of the waiting space.

As the transferring body in which the waiting space or the waiting space and preparing space are arranged, only one body may be used for the processing space having several openings for work, or a few bodies less than the number of the openings for work may be used. If several exits are arranged in the preparing space being set and fixed, several waiting spaces, that are transferring bodies, can be coupled.

According to the clean space system of this invention, not only the production line of semiconductor apparatuses as mentioned above, but also various processes which are not suitable to an environment in which a polluted worker goes in or out or in which clean surroundings are polluted can be put in various kinds of production lines which are required to be carried out in a clean space.

When a processing space is, between the opening for work in the processing space and the exterior surroundings, coupled with a preparing space consisting of a dressing room to change the worker clothes into a working uniform and a shower room to eliminate dust as well as coupled with a waiting space cleaned by air pollution removal in a degree similar to that of the processing space and, in addition, when the worker enters the processing space after being sufficiently cleaned of air pollution, various necessary operations can be carried out in the processing space without polluting the clean surroundings in the processing space.

However, a high cost and a large space are required to arrange the above-described preparing space and waiting space in each of a number of processes arranged in a series of production lines, so that the cost to arrange the whole facilities of production lines increase.

Therefore, it is not preferred to arrange a preparing space and a waiting space in each of several openings for work in the processing space, but to arrange the preparing space at one position or some few positions.

Then, in the case where the preparing space and the waiting space are arranged in the transferring body by uniting them into one body, the transferring body is transferred to an opening for work in the processing space which requires an operation and, with his opening for work, an opening in the waiting space is coupled. Under this condition, the worker goes in from an entrance of the preparing space, changes his clothes and cleans himself, passes through the waiting space, goes into the processing space from the opening for work of this space, and carries out various operations. Since only the clean waiting space is coupled with the processing space, invading of exterior polluted surroundings is not a concern. When the operations finish, the transferring body is separated from the opening for work and transferred to the position of a new opening to carry out a next operation. Doing this, a necessary operation can be carried out for any opening for work in the processing space without polluting clean surroundings in the processing space, by shifting the transferring body consisting of the unified preparing space and waiting space to an opening for work which requires the operation.

In the case where the waiting space is only arranged in the transferring body, the transferring body is transferred to a position of the preparing space being set and fixed, and it is kept in a condition that an opening of the waiting space is coupled with an exit of the preparing space. A worker who carried out necessary preliminary operations in the preparing space moves from the preparing space to the waiting space. When the transferring body is shifted to a position of an opening for work in the processing space to couple the waiting space with the processing space under a condition that the worker is in the waiting space, the worker is able to carry out an operation for the processing space similarly to the aforementioned. In this case, since a clean waiting space is coupled with the processing space, pollution of the processing space is not a concern. Similarly, if a preparing space which requires arranging a large apparatus and facilities is set and fixed, and if a waiting space having a simple interior structure is arranged in the transferring body, the apparatus structure such as a driving mechanism of the transferring body is simplified, a small driving power is enough, and reduction of the producing and operating costs is possible. Also, if several transferring bodies, that are waiting spaces, are at the same time or alternatively coupled for use with the only one preparing space, various operations can be carried out at the same time for a number of openings for work in the processing space.

When a running means is equipped in the transferring body, a worker who entered the waiting space is able to promptly access and move by himself to an opening for work in the processing space which is his purpose, his transferring feasibility increases and the exterior controlling facilities becomes unnecessary.

In the clean space relating to the present invention, as described above, when there is coupled a waiting space wherein preliminary actions such as change of clothes or washing movement necessary for carrying out the operations in the processing space are carried out, it becomes possible to carry out various operations for an opening for work requiring a direct operation of the worker in the processing space, without damaging clean surroundings of the processing space.

Especially, only the waiting space is arranged, into which a worker finished preliminary actions in the preparing space such as change of clothes and washing movement necessary for operating in the processing space enters, or both of the waiting space and preparing space are arranged, and then, if a waiting space of the transferring body is coupled with an opening for work in the processing space to bring a worker in contact with the processing space, it is unnecessary to arrange the preparing space in each of the openings for work of the processing apparatus. That is, if only one or some few preparing spaces are arranged, it is possible to send the worker to a number of openings for work under clean surroundings by transferring the transferring body.

As a result, it is possible to reduce the cost and occupating area of facilities of the preparing space greatly. Even if there is an enlargement and alteration in arrangement of the processing space, because only a change in a transferring route or a distance of the transferring body is enough, it is unnecessary to shift or build a larger preparing space and it becomes possible to respond very easily with alteration in a production line. Also, since it is possible to carry out an improvement or alteration of the preparing space independently of the processing space, operation of the processing space and production line is not affected by an improved working of the preparing space. If there is arranged only an opening for work at a position in the processing space, in which an operation is not performed at present, but there is a possibility to perform an operation in the future, it becomes possible to respond easily with an alteration in a process or facilities for processing in the future.

DESCRIPTION OF THE PREFERRED EMBODIMENTS

EXAMPLE

Hereinafter, the examples of applying a clean space system of this invention for a production line of a semiconductor apparatus are explained referring to figures.

Figure 1:
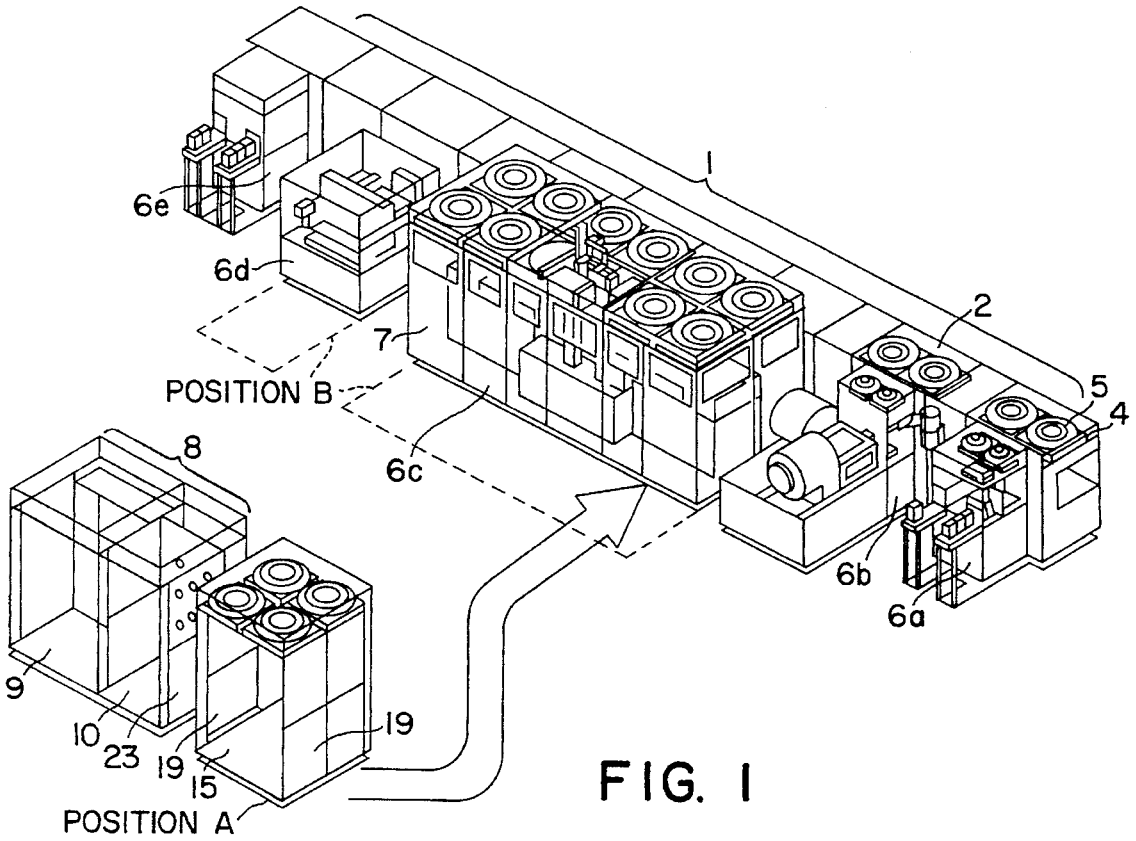
FIG. 1 is an external appearance perspective view of a clean space system in one example of the present invention.
Figure 2:
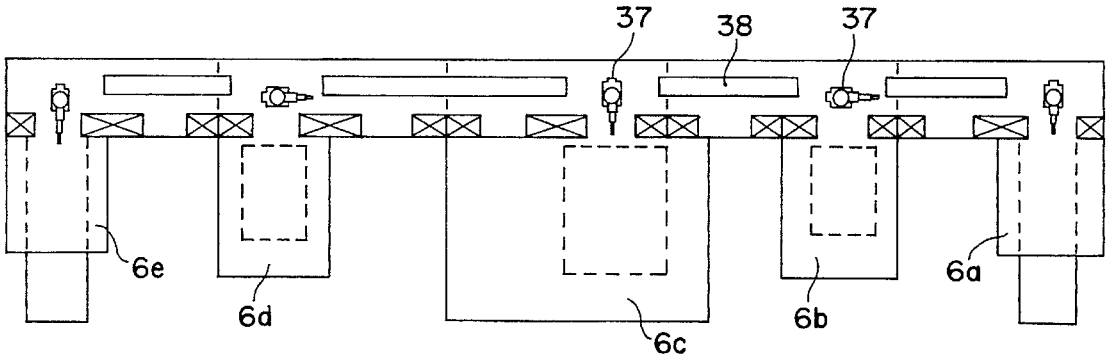
FIG. 2 is a plan view of the clean space system in FIG. 1.
Figure 3:
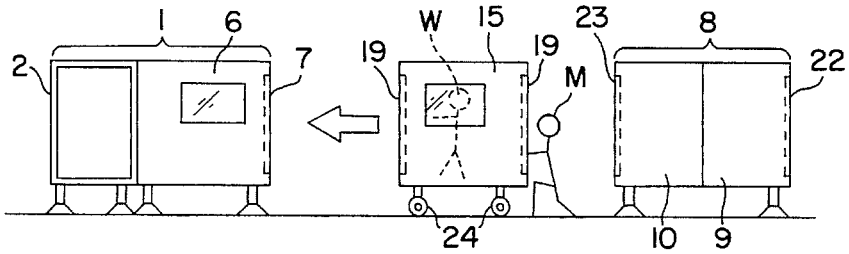
FIG. 3 is a side view of the clean space system in FIG. 1.

FIG. 1 is an external appearance perspective view of a clean space system which has realized a production line of a semiconductor apparatus. FIG. 2 is a plan view of the clean space system. FIG. 3 is a side view of the system.

A tunnel type clean space is made by coupling a number of space units 2 of a tube type straight. Articles to be processed are transported through the interior of each space unit 2 in sequence to undergo necessary processing. In each space unit 2 constructing a clean space, a dust catcher 4, an air-circulator 5, an air-conditioner (not shown in the figures) and so forth are arranged. Therefore, when a clean space is made by coupling the space units 2 of an optional number or by an optional arrangement, it is unnecessary to redesign or produce the dust catcher and the like. However, it is possible to arrange the dust catcher and others in a part of a constructed clean space 10 collectively.

In a part of the space units 2, working units 6 (also referred to as a second structure) are coupled on a face vertically crossing with a coupling direction of the space units 2. In the working unit 6, a processing apparatus is set to perform various kinds of process and operation. Exemplary apparatuses to perform an exemplary process and operation are set forth below.

**6*a* denotes a supplying module in which a transporting means to supply an article to be processed for a production line of a semiconductor in a clean space system is arranged, 6*b* denotes a sputter module in which a sputtering apparatus is arranged, 6*c* denotes a photolithomodule in which a photolithography processing apparatus is arranged, and 6*e* is a transporting means to take out an article to be processed after these various kinds of processing being performed in sequence. The modules are arranged in the above-mentioned order, as shown in FIGS. 1 and 2**.

Also, as shown in FIG. 2, a transporting means 38 to transport an article to be processed in sequence is arranged in a processing space in an interior of the space unit 2, and a robot for clean work 37 is arranged to carry out delivery and receiving of the article to be processed for each module, in which the article is transported by the transporting means 38, at a position of the opening where each of the modules of **6*a* to 6*e* constructing the working units 6 is coupled with the space unit 2**. With this construction, a series of processing steps are carried out automatically. The robot is constructed so as to maintain clean surroundings.

Further, an opening for work 7 is arranged at a terminal of these working units 6. The opening for work 7 is usually closed by a tightly closing door capable of intercepting pollution of surroundings such as dust invasion. This tightly closing door is called as an air lock door or an air tight door. A taper part is arranged at the circumference of the door and the door has a mechanism of being closed, by turning a lever arranged at the door, under a condition that the door is kept in touch with the taper part and pressed to make a very pushed state, so that a complete tight closing is realized.

A preparing space (also referred to as a first structure) is denoted by 8, which consists of a dressing room 9 to change clothes into an air-pollution free uniform and an air-shower room 10 to take off pollution particles attached to a worker's body, so that the worker to perform operations such as maintenance etc. in the processing space 1, especially in the working unit 6, does not pollute clean surroundings, and which is firmly set at a position apart from the working unit 6.

Figure 4:
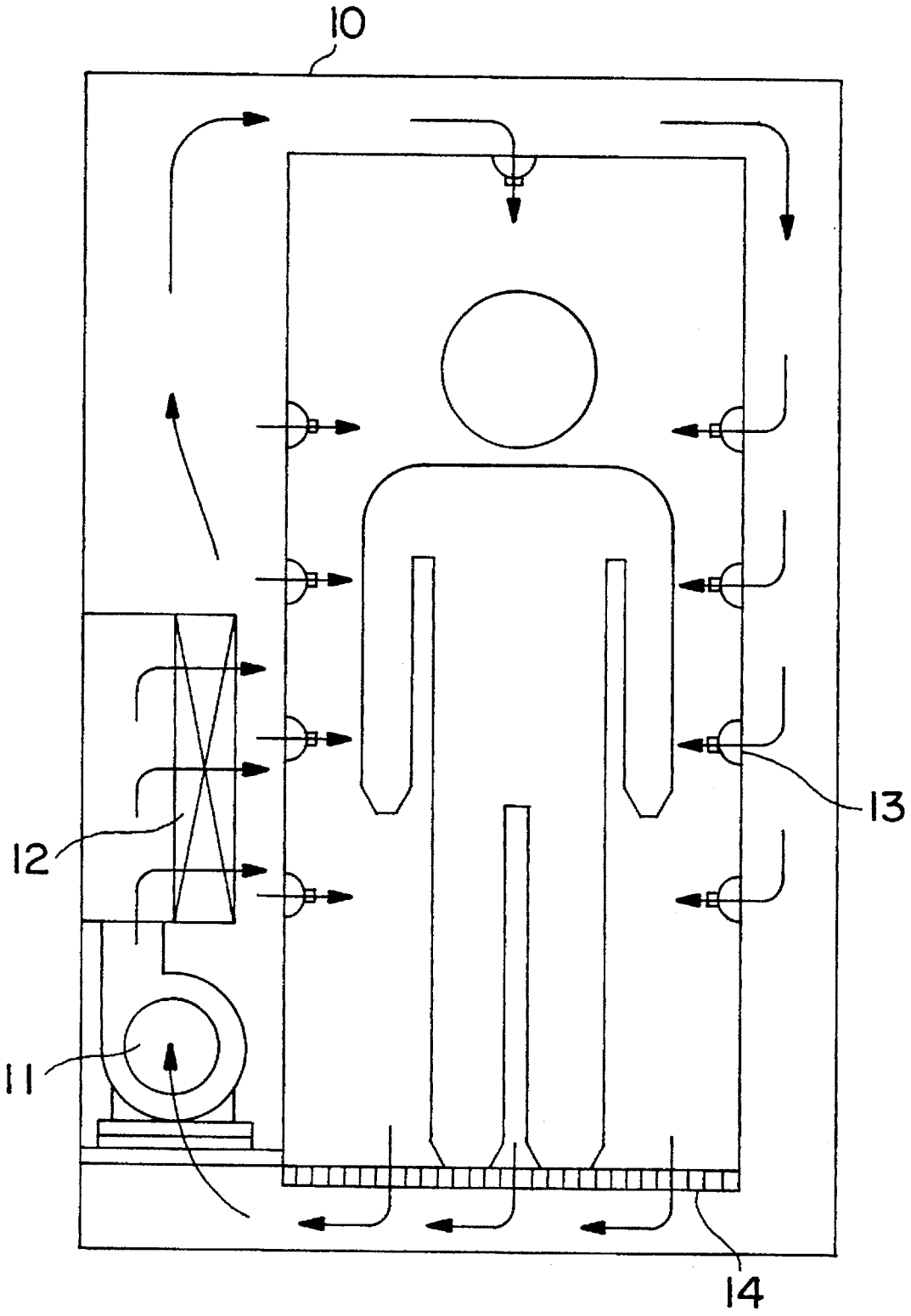
FIG. 4 is a schematic cross-sectional view of an air-shower room.

The dressing room 9 is quite similar to that generally used and, at both terminals of this room, an entrance 22 and exit 23 are arranged to go in and out. On the other hand, the air-shower room 10 has a structure as shown in FIG. 4. FIG. 4 is a schematic cross-sectional view of the air-shower room 10.

In this figure, the arrow mark indicates an air current and the 11 denotes a fan which is an air-circulator to circulate air in the air-shower room 10, 12 denotes a filter (e.g. a HEPA filter) which is a dust catcher to eliminate air dust exhaled the fan 11, 13 denotes an exhaling opening to exhale the air clarified by the HEPA filter 12 into a space where the worker is, 14 denotes a prefilter having a number of holes which inhales the exhaled air and performs a simple clarification. Furthermore, on a side which is not coupled with the dressing room 9, there is arranged an exit 23 closed by a tightly closing door so as to be capable of freely opening and closing. This tightly closing door has a construction similar to that used for the opening for work 7.

According to this construction, pollution particles attaching to the worker body are removed by blowing purified air on the worker from an upper side, then by inhaling the air through the prefilter 14 at a bottom face and circulating the air.

The waiting space (also referred to as a first structure) is denoted by 15, which is a space in which a sole or several workers cleaned in the preparing space 8 wait until he or they come in the working unit 6, which is a tightly closed space cleaned in a degree similar to or a little inferior to the processing space 1, and which is made of a kind of transferring body capable of freely running by wheels 24 being set on the down face. The waiting space 15 is sufficient if it has an area which makes it possible for the worker to come in, however, in a case where the worker performs an operation for the working space 6 under a condition that he is still in the waiting space 15, capacity capable of moving and operating by the worker should be secured.

Figure 5:
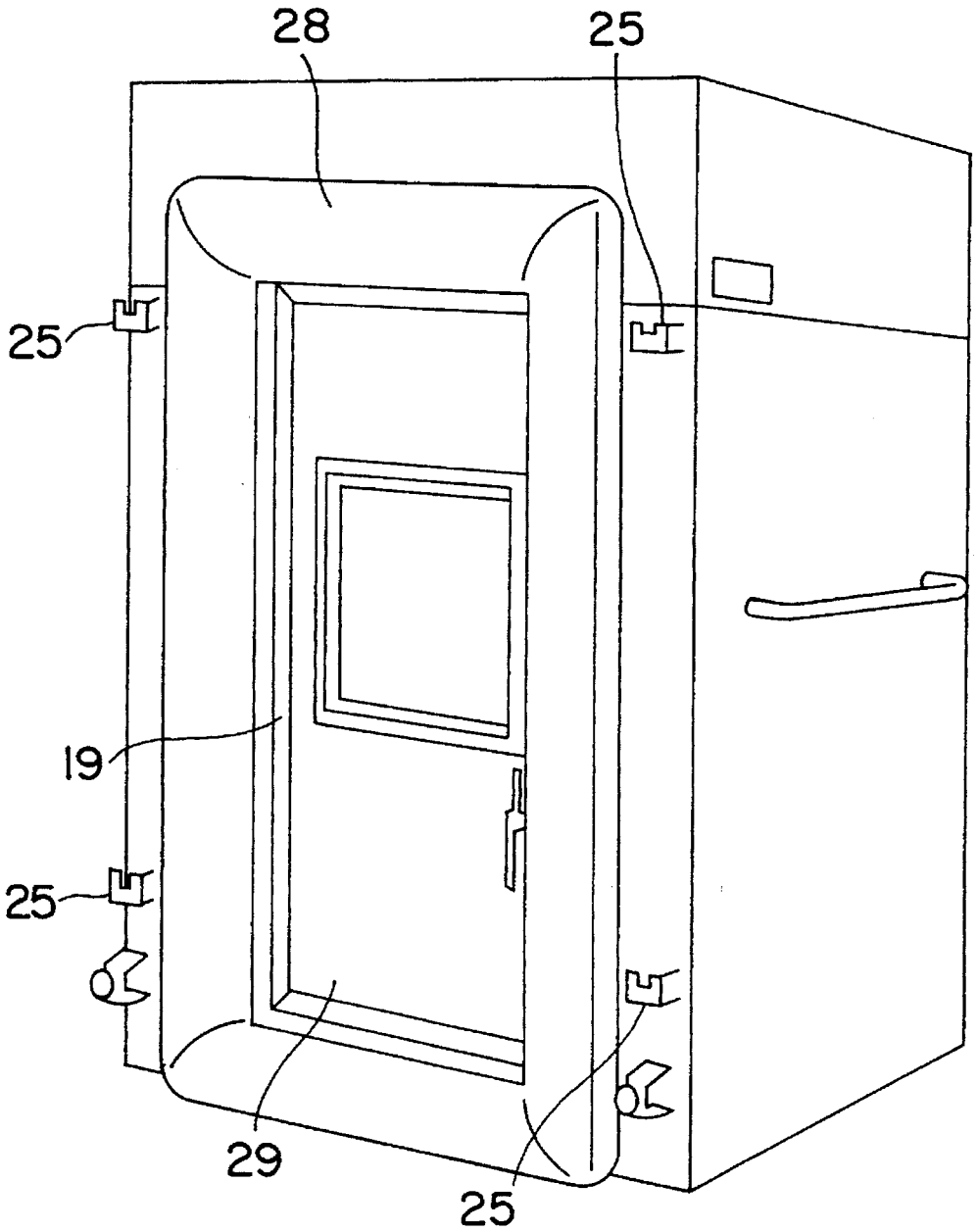
FIG. 5 is an external appearance perspective view of a waiting space.
Figure 6:
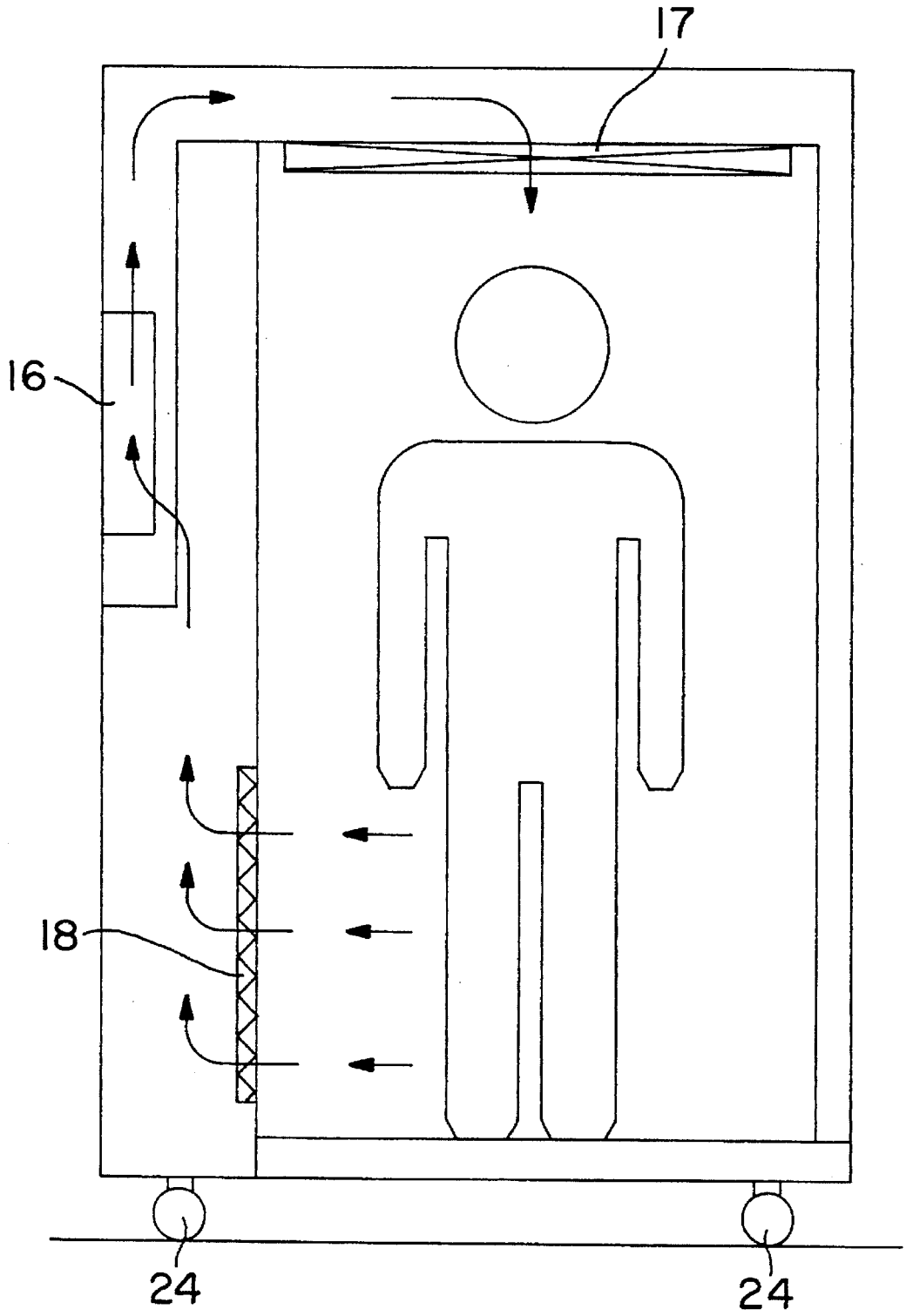
FIG. 6 is a side cross-sectional view of a waiting space in FIG. 5.

FIG. 5 is an external appearance perspective view of the waiting space 15, and FIG. 6 is a cross-sectional side view of the waiting space 15.

In the figures, 16 denotes a fan to circulate air in the waiting space 15, 17 denotes a filter (e.g. a HEPA filter) to eliminate dust contained in the air exhaled from 16 as well as to exhale the air into a space where the worker is, 18 denotes a prefilter to inhale the circulating air as well as to carry out simple air cleaning, and this construction is similar to the apparatus construction in the space units 2 and it realizes clean surroundings in a degree similar to those of the processing space 1.

Also, the opening 19 is arranged on at least one of the side faces of the waiting space 15. This opening 19 is set so as to be capable of coupling with and separating from the opening for work 7 of the working unit 6 and the exit 23 of the air-shower room 10, under a condition of being shut from exterior surroundings. This coupling and separating is explained referring to figures.

Figure 7:
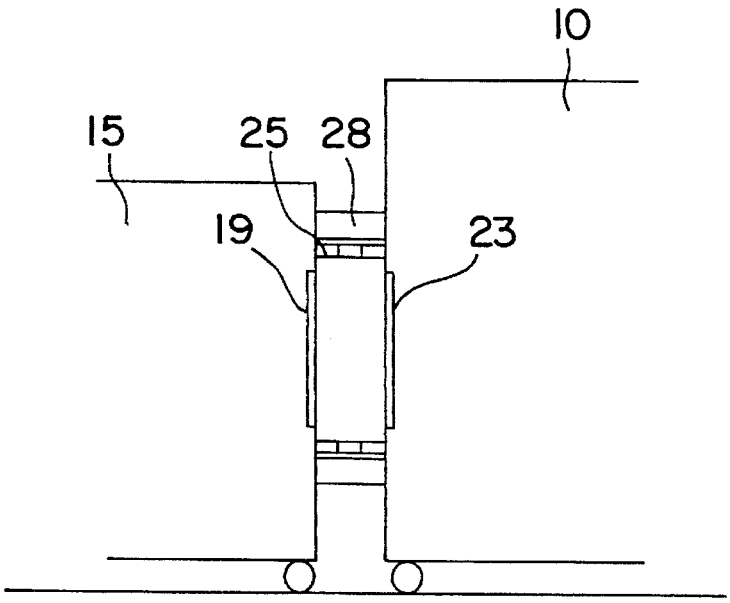
FIG. 7 is an illustrative view to show a coupling process between two spaces.

FIG. 7 shows a coupling process. In this figure, 25 denotes a lock mechanism to firmly fix so that the two spaces 10 and 15' do not separate more than a defined distance, and instruments to construct the lock mechanism in the respective space are arranged. The 28 denotes a doughnut type hollow rubber ring which acts as a seal in coupling the two spaces 10 and 15.

In this construction, when the two spaces 10 and 15 are coupled, the lock mechanism firmly fixes the spaces 10 and 15, the hollow rubber ring 28 expands by air running into this ring 28, an exterior wall forming each space is pressed by the rubber ring 28 for closing-up between the two space, invasion of external air into the spaces 10 and 15 is prevented, and the two spaces 10 and 15 become an airtight condition.

When the coupled two spaces 10 and 15 are separated, the air run into the hollow rubber ring 28 is exhaled in such a degree as the lock mechanism 25 is unfastened, and the lock mechanism 25 is discharged.

Doing this, coupling and separating of the two spaces 10 and 15 can be optionally and easily carried out.

Figure 8:
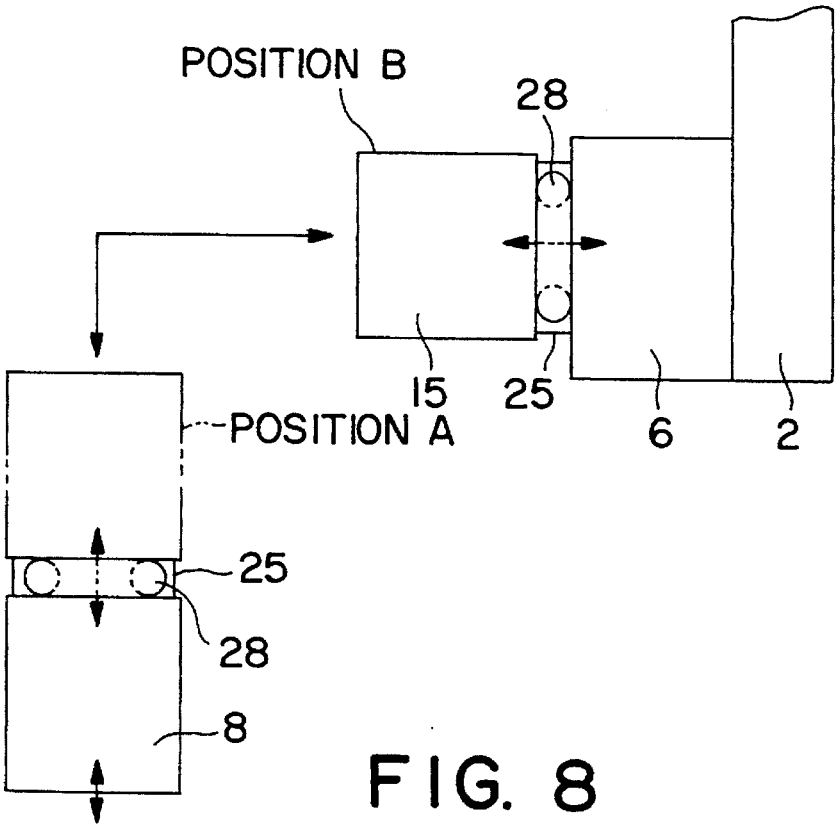
FIG. 8 is an supplementary view to explain operation such as maintenance.

Hereinafter, an operation such as maintenance in a clean space system having a structure as mentioned above is explained referring to figures. FIG. 8 is a supplementary view to explain the operation, and the explanation is given including this view and also, referring especially to FIGS. 1 and 3.

Even in a case where various kinds of processes and operations are carried out without a worker in a clean space which is completely isolated from exterior surroundings by the supplying module 6*a*, sputter module 6*b*, photolitho-module 6*c*, etching module 6*d*, and module to take out 6*e*, it becomes necessary to carry out a maintenance operation such as inspection and repair of an apparatus.

Accordingly, the worker goes in the working unit 6 through the preparing space 8 and waiting space 15.

First, at an initial point, the preparing space 8 consisting of the dressing room 9 and air-shower room 10 is, according to the aforementioned coupling process, coupled with the waiting space 15 under a condition of completely shut from exterior surroundings, and the waiting space 15 is at a position A.

The worker goes from the entrance 22 into the dressing room 9, changes his clothes to a clarified uniform, and then, goes in the air-shower room 10, in which pollution particles attached to his body are washed off. Furthermore, he goes in the waiting space 15 coupled with the air-shower room 10 by the forementioned method, and closes the tightly closing door 19 arranged at a border between the air-shower room 10 and the waiting room 15. Still further, he exhales the air in the hollow rubber ring 28, discharges the lock mechanism 25, so that separating of the waiting space 15 from the air-shower room 10 becomes possible. Next, the waiting space 15 is transferred to a position B By a human power, the opening 19 is coupled with the opening 7 of the working unit 6, and the forementioned coupling is carried out.

After completion of this coupling, the worker opens the tightly closing door 29 Between the waiting space 15 and the working unit 6, enters inside the working unit 6, and performs an operation such as maintenance, etc. After completion of the operation, according to a procedure similar to the above, the waiting space 15, that is a transferring body, is returned to a position of the preparing space 8, and then, the worker W may goes out, or the transferring body may be intact transferred to a position of the opening for work 7 where a next operation is carried out. In this example, several transferring bodies; that are the waiting space 15, are prepared for a preparing space 8 at one place and then, by accomodating the worker W in the respective waiting spaces 15 and by coupling this spaces 15 with several openings for work 7 in the processing space 1, it becomes possible to carry out operations at the same time at the several openings for work 7.

Figure 9:
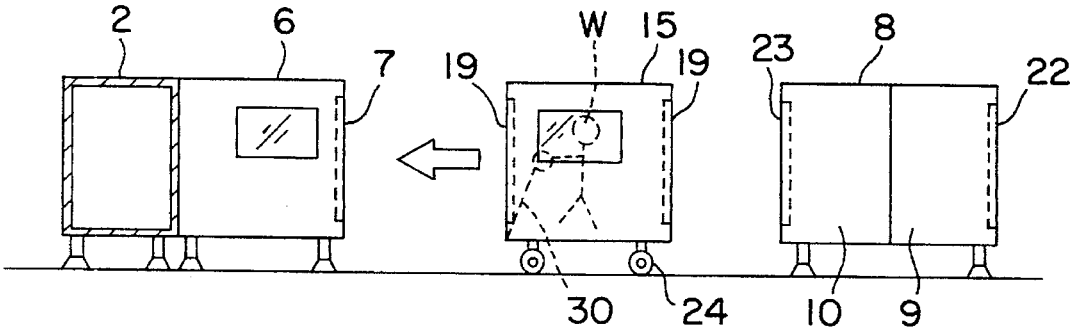
FIG. 9 is a side view to show another example of the present invention.

Next, in each example mentioned above, the waiting space 15, that is a transferring body, is transferred by a human power M of from an exterior, but as shown in FIG. 9, the waiting space 15, that is a transferring body, may be operate by a worker himself who entered 15.

That is, in the waiting space 15 that is a transferring body, a driving means such as an electric motor and an operating means such as a handle 30, an accelerator and a brake are arranged, so that the worker W can operate freely. Doing like this, it is possible for the worker W to carry out all operations by himself alone, so that reduction of labor can be intended and also, the waiting space 15 can be brought to an optional position in the processing space 1. Accordingly, these are very preferable in a production line having extension or alteration of the processing space 1 frequently.

Figure 10:
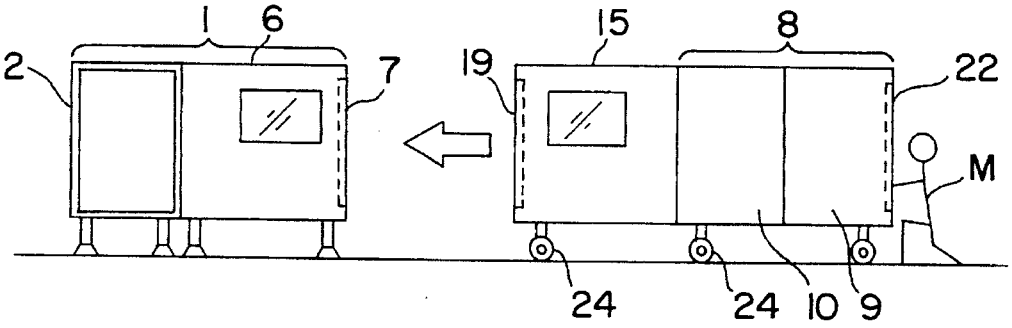
FIG. 10 is a side view to show another example of the present invention.

Also, in the present example, a transferring body is made by only the waiting space 15, but as shown in FIG. 10, it is possible to make a transferring body by incorporating the waiting space 15 and preparing space 8 into one body.

What is claimed are:

1. A clean space system for use by a worker, comprising:

a first structure including a first structure space and an air shower for cleaning said worker, said first structure including a first structure portion with a first structure opening;

a second structure physically separate from said first structure, said second structure including a second structure portion which includes a second structure wall forming a second structure opening, and a clean space which is free from pollution particles;

a movable third structure for coupling with and decoupling from said first structure portion and said second structure portion, said third structure including a third structure space maintained as a further clean space in which said worker waits and a third structure wall having a third structure opening and expandable ring means for containing air, said ring means disposed between said second structure wall and said third structure wall for sealing and coupling said second and third structures, wherein the worker moves from the first structure space to the third structure space, to said second structure.

* * * * *